US006729653B1

(12) United States Patent
Greer

(10) Patent No.: US 6,729,653 B1
(45) Date of Patent: May 4, 2004

(54) HINGED BOOK HOLDER

(76) Inventor: Edwin Clarence Greer, 5047 Parkhurst Dr., Santa Rosa, CA (US) 95409

( * ) Notice: Subject to any disclaimer, the term of this patent is extended or adjusted under 35 U.S.C. 154(b) by 0 days.

(21) Appl. No.: 10/188,437

(22) Filed: Jul. 2, 2002

(51) Int. Cl.[7] ..... B42D 3/00

(52) U.S. Cl. ..... 281/45; 40/341; 206/308.1; 211/42; 281/51; 248/44.1; 248/444.1; 248/453

(58) Field of Search ..... 281/42, 44, 45, 281/51; 248/441.1, 444.1, 447, 448, 451, 452, 453, 454, 457, 458, 462; 211/42; 206/308.1; 40/341

(56) References Cited

U.S. PATENT DOCUMENTS 4,102,071 A * 7/1978 D'Arcy ..... 40/531
5,405,010 A * 4/1995 Goldberger ..... 206/5
5,474,333 A * 12/1995 Schrader ..... 281/45
6,283,432 B1 * 9/2001 Hoose, Jr. ..... 248/441.1
6,439,533 B2 * 8/2002 Armstrong ..... 248/447.1
6,439,612 B1 * 8/2002 Greer ..... 281/45
6,446,803 B1 * 9/2002 McKinney ..... 206/371

* cited by examiner

*Primary Examiner*—Monica S. Carter
(74) *Attorney, Agent, or Firm*—Risto A. Rinne, Jr.

(57) ABSTRACT

An apparatus for supporting a book or magazine for reading includes a bottom member and a top member. The top member is elevated at one end above the bottom member and is adapted to pivot about an axis from a first closed position for reading into a second open position for turning the pages. At least a portion of the top member is transparent to permit viewing of printed matter through the top member, which is adapted to press upon the book or magazine when it is disposed in the first position. A lip is attached to the bottom member and is used to further retain the book or magazine in position. A marking device is optionally detachably-attached to a top portion of the apparatus. A stand is described upon which the apparatus may be placed for hands-free use.

18 Claims, 3 Drawing Sheets

HINGED BOOK HOLDER

RELATED APPLICATION

This patent application is related to a currently pending patent application filed by the same inventor entitled "Book Holder", Ser. No. 09/852,557, that was filed on May 10, 2001 and which is currently approved for issuance as a patent.

BACKGROUND OF THE INVENTION

1. Field of the Invention

The present invention, in general relates to devices that are used with a book and, more particularly, to devices that hold a book open for reading.

There is a long standing need to hold a book open for reading. As almost everyone is aware, the pages of a book tend to close of their own, due to forces that are imparted to the pages primarily by the binding.

As a result, the reader must deliberately maintain the pages in an open position. This can be, at times, inconvenient. At least one hand is generally required to maintain the pages open.

There is a need for a book holder to hold the pages open for use with either a hard cover type of a book, a paperback book, or a magazine.

Because the overall size (including the thickness) of the various books and magazines are extensive, it is desirable for a book holder to be able to accommodate the great variety of books and magazines that may be encountered.

If a prior type of a book holder has either complex members or other types of moving members to accommodate these different types and sizes of books and magazines, whatever members may be used to hold the pages of the book open will tend to obscure the printed material when these prior types of holders are used with still other types and sizes of books.

Therefore, there is a need to be able to accommodate different types and sizes of books and magazines so as to be able to hold the pages open while not obscuring the print that appears on any of the pages.

A similar problem mentioned briefly hereinabove is related to the thickness of the book and binding which can prevent certain prior art types of a book holder from properly closing (i.e., securing the pages in an open position) around the book for optimum reading comfort. Therefore, it may not properly accommodate the thickness of the book.

Accordingly, there is also a need for a book holder that is inexpensive to manufacture.

There is a further need for a book holder that is aesthetically pleasing in its appearance.

There is also a further need for book holder that includes a straight edge. This is useful to underline text, when desired. A person reading a text book, for example, may wish to "highlight" certain passages for future study.

Furthermore, there are times when it is desirable to rest the book on a bed or a desk or similar object without the reader having to physically hold it. This can occur for many reasons, including those times when portions of the text are excerpted and the reader wants to hold the pages open while typing occurs. It is desirable to be able to hold the pages in an open position without the reader having to hold the book. It is desirable also to permit rapid turning of the pages when necessary.

There are other times when it is desirable not to rest the book upon a surface but to be able to hold it with only one hand. However, the conventional hand posture for holding a book requires that part of the hand be used to maintain the pages in an open position while the rest of the hand is used to support the full weight of the book. For many readers, the hand must raise the book to a height that requires great strain to maintain and to support. Ideally, a book holder that includes a convenient hand-hold and which holds the pages open is desirable.

This is especially true if the hand-hold mechanism allows the reader to support the book with their hand at a lower position. Their hand could then even rest directly upon a surface. Then, the reader would primarily be required only to balance the book (rather than lift and to support its weight).

Furthermore, there is need for a hinged book holder to allow easy turning of the pages without having to remove the book from the book holder prior to turning them. Ideally, a book holder will permit the reader to grasp the next page to be turned prior to reaching the end of the text to be read. The reader could then slightly elevate the page and place the thumb of this hand under a pivoting member of the book holder. Upon reaching the end of the text, the reader would then pass the thumb under the page to be turned while simultaneously raising both the pivoting member and the page until the page has been fully turned. The reader then pulls his thumb out from under the pivoting member which then returns to a rest position in contact over the next two pages to be read.

As mentioned hereinabove, there is a need for a straight edge that can be used to underline or highlight portions of text. There is a need for a hinged book holder that is adapted to conveniently secure a marking device, reading glasses, or other reading accessory thereto that can be removed when desired.

In general, it is difficult to support a book and keep it open with only one hand. The pages tend to close around the hand that is supporting it. This usually results in the reader having to use two hands to support the book and keep it open during reading. There is a need for a book holder that permits the reader to support the book and book holder with only one hand and which keeps the pages open. For this to occur, there is a further need that any such type of a book holder be light in weight.

Accordingly, there exists today a need for a hinged book holder that can ameliorate as many of these problems as is possible and do so at as low a cost as is possible.

Clearly, such an apparatus would be a useful and desirable device.

2. Description of Prior Art

Book holders are, in general, known. For example, the following patent describe various types of these devices:

U.S. Pat. No. 6,109,658 to Moore, Aug. 29, 2000.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a hinged book holder that is inexpensive to manufacture.

It is also an important object of the invention to provide a hinged book holder that is adapted for use with a book.

Another object of the invention is to provide a hinged book holder that is adapted for use with a magazine.

Still another object of the invention is to provide a hinged book holder that is adapted for use with a hardcover type of a book.

Still yet another object of the invention is to provide a hinged book holder that is adapted for use with a softcover type of a book.

Yet another important object of the invention is to provide a hinged book holder that is adapted for placement directly upon a bed, desk, or other type of a surface.

It is a first continuing object of the invention to provide a hinged book holder that is adapted for use with a support stand for hands-free operation.

It is a second continuing object of the invention to provide a hinged book holder that includes an attachment point for detachably-attaching a marking device.

It is a third continuing object of the invention to provide a hinged book holder that includes an attachment point for detachably-attaching a highlight type of a marking device.

It is a fourth continuing object of the invention to provide a hinged book holder that is adapted for use with various sizes of books and magazines.

It is a fifth continuing object of the invention to provide a hinged book holder that is adapted to accommodate the thickness of the binding.

It is a sixth continuing object of the invention to provide a hinged book holder that includes a member that covers a portion of the pages that is transparent.

It is a seventh continuing object of the invention to provide a hinged book holder that includes a lip attached to a bottom member that is adapted to retain a book thereon.

It is an eighth continuing object of the invention to provide a hinged book holder that can automatically adapt for use with books having a wide range of thickness'.

Briefly, a hinged book holder that is constructed in accordance with the principles of the present invention has a planar bottom member upon which a book, magazine, or other type of reading material is placed. A first end of a substantially planar top member is disposed a predetermined distance above a first end of a bottom member. A first end of an intermediate member extends from the first end of the bottom member to a first end of a hinge. An opposite second end of the intermediate member is attached to the first end of the hinge. An opposite second end of the hinge is attached to the first end of the top member. The top member is adapted to pivot about an axis of the hinge between a first closed position and a second open position that is adapted for turning a page or removing or inserting the reading material. In the first closed position, an opposite second end of the top member is adapted contact at least a portion of an opposite second end of the bottom member when the book, magazine, or other reading material is not inserted in the hinged book holder. In the first closed position absent the reading material, a cross-sectional side view of the hinged book holder forms a triangle. At least a portion of the top member is transparent, through which a printed matter may be read. A lip is attached to a bottom edge of the bottom member and is used to retain the reading material thereon. An area is provided proximate the hinge that is adapted for detachably-attaching a marking device. According to a modification, a detachable stand is provided upon which the hinged book holder is placed.

DETAILED DESCRIPTION OF THE INVENTION

Figure 1:
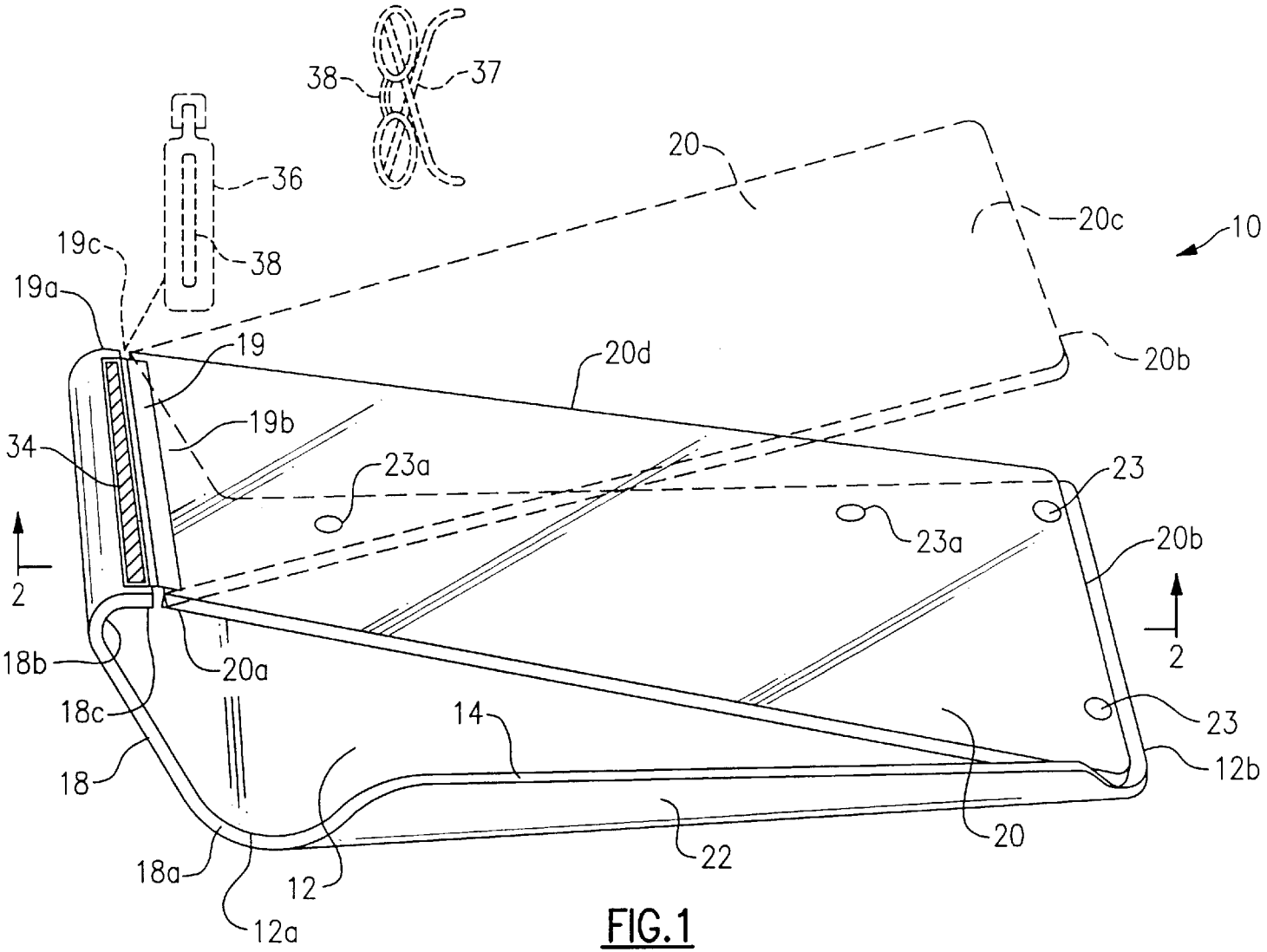
FIG. 1 is a view in perspective of a hinged book holder with a top member (shown in two positions) above a bottom member.

Referring to all of the FIGURE Drawings and in particular now to FIG. 1 is shown, a hinged book holder, identified in general by the reference numeral 10.

The hinged book holder 10 includes a substantially planar bottom member 12.

A raised lip 14 extends along a bottom edge of the bottom member 12 and is used to retain a book (not shown) therein. Insertion of the book is described in greater detail hereinafter and is similarly shown in the related patent application identified hereinbefore and which is hereby incorporated by reference herein.

A first end of the bottom member 12*a* includes an intermediate member 18 that is attached to the first end of the bottom member 12*a* at a first end of the intermediate member 18*a*. The intermediate member 18 is substantially a planar member that extends therefrom a predetermined distance along a first plane that is in a direction that is generally up and away from the first end of the bottom member 12*a*.

The intermediate member 18 includes a radius 18*b*. The radius 18*b* extends the intermediate member 18 into a second plane that is not in parallel planar alignment with respect to the first plane. The second plane of the intermediate member extends for a second predetermined distance in a parallel space apart orientation with respect to the bottom member 12 and in a direction that extends it away from the radius 18*b* and toward a second opposite end 12*b* of the bottom member 12.

A first end 19*a* of a hinge 19 is attached to a second end 18*c* of the intermediate member 18. The second end 18*c* of the intermediate member 18 is disposed above and away from the first end 18*a* thereof. An opposite second end 19*b* of the hinge 19 is attached to a first end 20*a* of a top member 20.

The size, shape, height, and angle of the first plane of the intermediate member 18 are variables that are selected to match the particular design of the hinged book holder 10. Similarly, any of the component parts of the hinged book holder 10 may be modified or scaled to suit the application at hand. For example, a smaller version may be used with paperback types of the book whereas a larger version may be used with hardback types of the book or with magazines.

Furthermore, while the various component parts that comprise the hinged book holder 10 are described separately for purposes of clarity, a preferred method for its manufacture includes molding techniques so as to provide the hinged book holder 10 with many of the component parts as described herein in as few separate component parts as possible and optimally, as a one piece integral unit. When this is accomplished, the method of attachment of one component part to another is that of having them molded together as an integral component part.

The intermediate member 18 is preferably molded so as to be included as a unit that is formed integrally with the bottom member 12 and the lip 14. This provides a smoother appearance, one that affords optimum aesthetic appeal.

The top member 20 is adapted to pivot proximate the first end thereof 20*a* with respect to the bottom member 12 about an axis 19*c*, the axis 19*c* being shown in dashed lines.

A preferable design is to utilize the weight that is inherent in the material of the top member 20 to provide sufficient weight to bear upon the pages of the book. Also, during use, it is common for a reader (not shown) to grasp the entire hinged book holder 10 between a thumb and some of the fingers of one hand, thereby naturally squeezing the hinged book holder 10 in the hand and urging the top member 20 toward the bottom member 12 during use an amount that is sufficient to retain the book in position therein.

Accordingly, the top member 20 is adapted to pivot from a first closed position (as shown) in which a second end thereof 20*b* that is opposite with respect to the first end thereof 20*a* is disposed proximate a second end 12*b* of the bottom member 12 into a second open position 20*c* (shown in dashed lines) in which the second end thereof 20*b* is disposed away from the bottom member 12 sufficient to allow the pages of the book to be turned or for the book to be either removed from or inserted in the hinged book holder 10.

Figure 2:
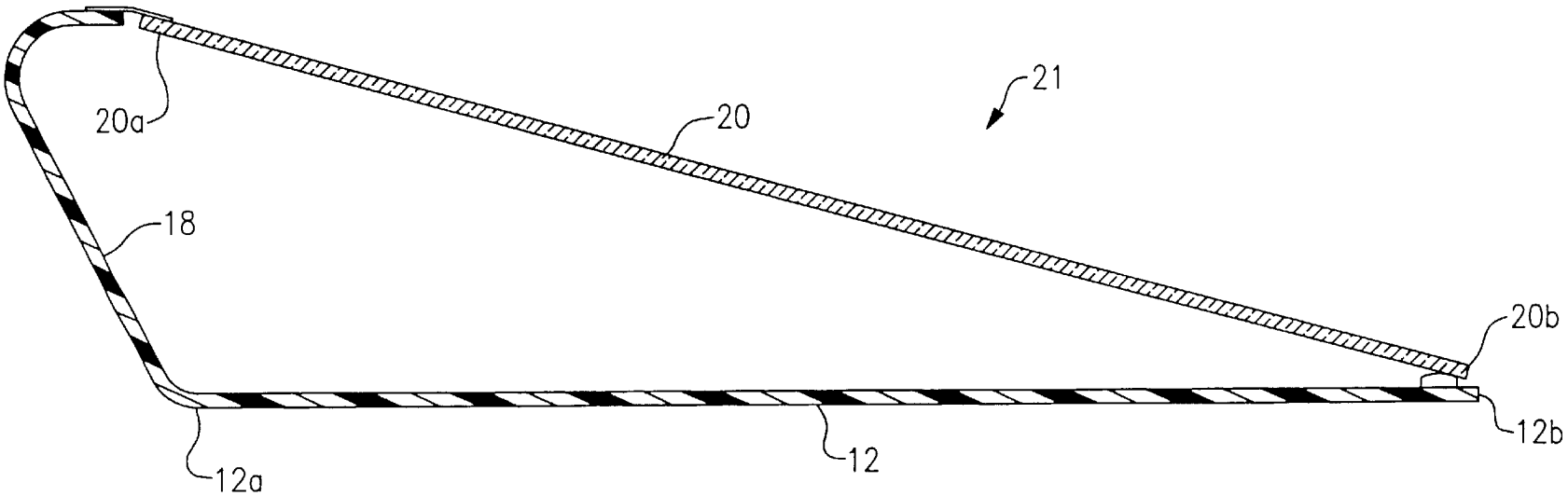
FIG. 2 is a view in cross-section of the hinged book holder that is shown in FIG. 1 taken along the line 2—2.

Referring now also to FIG. 2, a cross-section, identified in general by the reference numeral 21, of the hinged book holder 10 is shown when the top member 20 is the first closed position and the book is not inserted between the top member 20 and the bottom member 12, as is common during use.

The cross-section 21 includes a triangular shape. The triangular shape includes two legs (i.e., the bottom member 12 and the top member 20) and a base (i.e., the intermediate member 18). The base disposes the first end 20*a* of the top member 20 away from the first end 12*a* of the bottom member 12 an amount that is sufficient to place any desired thickness of the book (i.e., reading material) therein for which the hinged book holder 10 is adapted for use.

The second end 20*b* of the top member 20 pivots away from the second end 12*b* of the bottom member 12 any amount that may be necessary to accommodate the book therein. Accordingly, the triangular shape is of substantial benefit in adapting the hinged book holder 10 to accommodate a variety of sizes of the book.

Referring again primarily to FIG. 1, when the top member 20 is disposed in the first closed position, it is noted that the second end thereof 20*b* is disposed slightly in from the second end 12*b* of the bottom member 12. This allows the reader to more easily separate the bottom member 12 apart from the top member 20 for pivoting the top member 20 into the second open position 20*c*.

The raised lip 14 is attached to a bottom edge of the bottom member 12 and it extends along the bottom edge for a predetermined distance. The lip 14 includes a substantially planar upright member 22 that is preferably molded as an integral part of the bottom member 12 and is disposed at an angle with respect to the bottom member 12. Preferably, the angle is nearly ninety degrees (i.e., perpendicular).

The lip 14 prevents the book from sliding out of the hinged book holder 10 when a top of the book is elevated with respect to a bottom of the book.

A pair of protrusions 23 may be included proximate the second end 12*b* of the bottom member 12. The protrusions 23 extend upward away from the bottom member 12 toward the top member 20. The protrusions 23, if used, elevate the second end 20*b* of the top member 20 a slight amount above the bottom member 12 thereby making it even easier to grasp the second end 20*b* of the top member 20.

An additional pair of protrusions 23*a* are included, as desired, proximate an upper edge of the bottom member 12 that similarly extend upward and away from the bottom member 12.

The protrusions 23, 23*a* provide other benefits as well, including elevating the top member 20 above the bottom member sufficient to prevent the top member 20 from scratching or otherwise abrading the bottom member 12. The protrusions 23, 23*a* also provide a method for increasing the friction between the bottom member 12 and the book, thereby helping to secure (i.e., keep) the book in position during use.

Figure 3:
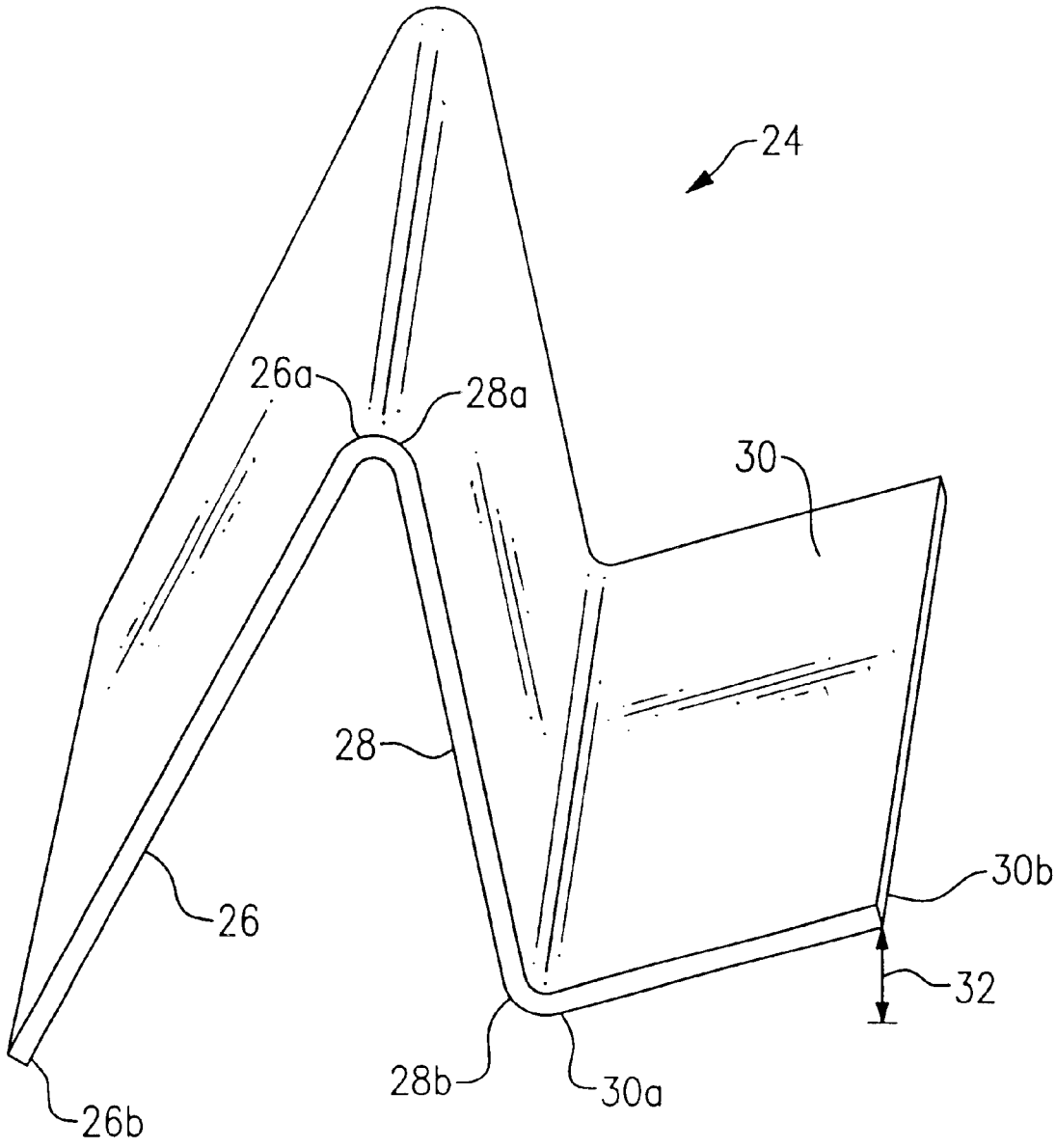
FIG. 3 is view in perspective of an optional stand.

Referring now in particular to FIG. 3, is shown a stand, identified in general by the reference numeral 24. The stand 24 is adapted for placement on any level planar surface, for example, a desk (not shown).

The stand 24 includes a first angled planar member 26 and a second angled planar member 28 that are attached at an upper end of each 26*a*, 28*a*. A lower end 26*b*, 28*b* of each are in contact with the level planar surface upon which the stand 24 is placed.

A planar support member 30 is attached at a first end thereof 30*a* to the lower end 28*b* of the second angled planar member 28. The planar support member 30 is disposed at a ninety degree angle with respect to the second angled planar member 28.

The planar support member 30 includes an opposite second end thereof 30*b* that extends a predetermined distance away from the first end thereof 30*a*. The second end thereof 30*b* is elevated above the level planar surface by an amount that is shown by arrow 32.

When the stand 24 is used, it is placed on the level planar surface and the hinged book holder 10 (and book contained therein) are placed on the planar support member 30. The back of the bottom member 12 rests against the second angled planar member 28 and the planar upright member 22 rests upon the top of the planar support member 30. The hinged book holder 10 and the book tilt backward and are held in position on the stand by the force of gravity with the top member 20 keeping the pages of the book open for hands-free reading.

Referring again primarily to FIG. 1, a first half of a hook and loop fastener 34 is attached to an upper surface of said hinged book holder 10. A preferable location for the attachment of said first half of a hook and loop fastener 34 is either on said hinge 19 or on said intermediate member 18 proximate said second end 18*c* of said intermediate member 18.

A marking device 36 (shown elevated for clarity) above said hinged book holder 10 includes on a bottom thereof a second half of a hook and loop fastener 38. The second half of a hook and loop fastener 38 cooperates with the first half of a hook and loop fastener 34 to detachably-attach the marking device to the hinged book holder 10. The marking device 36 may include a pen pencil or highlight type of a marker. Accordingly, the marking device 36 is always close at hand ready for use. A top edge 20*d* of the top member 20 can be used to provide a straight edge to assist during use of the marking device 36. Other edges (not identified) of the hinged book holder 10 may also be used for this purpose, as desired.

A reading accessory 37, for example reading glasses, may also be similarly attached to the hinged book holder 10 with another quantity of the second half of a hook and loop fastener 38. The reading accessory 37 may be included in addition to the marking device 36 or, if preferred, in its place.

The hinge 19, as described hereinabove, is attached to both the intermediate member 18 and to the top member 20. The method of attachment can include the use of an adhesive or any desired type of fastening device, for example screws (not shown), or bolts and nuts (not shown). It is also possible to mold the hinge 19 so as to be included in or as a part of the intermediate member 18 or the top member 20 or both. As an alternative, the hinge 19 can include any type of a membrane hinge which can be attached to the intermediate member 18 and to the top member 20 using any preferred method.

The book will typically include a height that is greater than the width of the top member 20. Accordingly, an upper portion of the book will extend past the top member 20. The top member 20, which covers only a portion of the book, must be transparent so as to permit the reader to read the printed material (i.e., the text) that is disposed above the top member 20 and to continue reading the printed material that is disposed under the top member 20.

Accordingly, the hinged book holder 10 is adapted to secure a book for reading that is larger than the hinged book holder 10. This is a significant improvement over the known prior art for many reasons. The hinged book holder 10 is therefore less expensive to manufacture, package, ship, display, etc.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A hinged book holder adapted for receiving a printed matter, comprising:

(a) a substantially planar bottom member adapted to receive said printed matter;

(b) a substantially planar top member disposed above said bottom member; and (c) an intermediate member attached at a first end thereof to a first end of said bottom member and attached at an opposite second end thereof to a first end of a hinge, and wherein a second end of said hinge is attached to a first end of said top member, and wherein said first end of said top member is disposed a predetermined distance above said first end of said bottom member and wherein said top member is adapted to pivot about an axis of said hinge with respect to said bottom member from a first closed position in which a second end of said top member is disposed proximate said bottom member into a second open position in which said second end of said top member is disposed away from said bottom member, and wherein at least a portion of said top member is transparent, and wherein a center cross-section is substantially triangular in shape when said top member is disposed in said first closed position; and wherein said intermediate member includes a first plane that extends from said first end of said bottom member in an upward direction away from said bottom member; and wherein said intermediate member includes a radius that terminates said first plane at one end of said radius and extends into a second plane of said intermediate member.

2. The hinged book holder of claim 1 wherein said bottom member includes a lip and wherein said lip is adapted to retain said printed matter atop said bottom member.

3. The hinged book holder of claim 1 wherein said second plane extends in a direction that is in substantially parallel planar alignment with respect to said bottom member.

4. The hinged book holder of claim 3 wherein said second plane extends in a direction that is generally toward said second end of said bottom member.

5. The hinged book holder of claim 4 wherein said hinge is disposed intermediate said second plane of said intermediate member and said first end of said top member.

6. The hinged book holder of claim 1 including means adapted for attaching a reading accessory to a surface of said hinged book holder.

7. The hinged book holder of claim 6 wherein said means adapted for attaching a reading accessory includes attaching a marking device.

8. The hinged book holder of claim 6 wherein said reading accessory includes reading glasses.

9. The hinged book holder of claim 6 wherein said means adapted for attaching a reading accessory is adapted to attach said reading accessory to an upper surface of said hinged book holder.

10. The hinged book holder of claim 9, wherein said means adapted for attaching a reading accessory is adapted to attach said reading accessory to said hinge.

11. The hinged book holder of claim 9, wherein said means adapted for attaching a reading accessory is adapted to attach said reading accessory to an upper surface of said intermediate member.

12. The hinged book holder of claim 1 wherein said top member is adapted to press upon a portion of said book when said top member is disposed in said first closed position.

13. The hinged book holder of claim 1 wherein said bottom member includes at least one protrusion disposed on an upper surface thereof.

14. The hinged book holder of claim 1 wherein said bottom member includes means for increasing friction.

15. The hinged book holder of claim 1 wherein said hinge includes a membrane hinge.

16. The hinged book holder of claim 15 wherein said membrane hinge is attached to said intermediate member and to said top member.

17. The hinged book holder of claim 15 wherein said membrane hinge is molded as an integral part of said intermediate member and of said top member.

18. The hinged book holder of claim 1 wherein said at least a portion of said top member that is transparent covers a portion of said printed matter that is visible for viewing and wherein said portion is less than all of said printed matter that is visible for viewing.

* * * * *